US007559775B2

(12) United States Patent
Lin et al.

(10) Patent No.: US 7,559,775 B2
(45) Date of Patent: Jul. 14, 2009

(54) ELECTRICAL CARD CONNECTOR ASSEMBLY

(75) Inventors: Kuo-Lung Lin, Tu-cheng (TW); Chien-Jen Ting, Tu-cheng (TW); Yung-Chang Cheng, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/156,795

(22) Filed: Jun. 4, 2008

(65) Prior Publication Data

US 2008/0299794 A1 Dec. 4, 2008

(30) Foreign Application Priority Data

Jun. 4, 2007 (TW) ..... 96119890 A

(51) Int. Cl.
*H01R 13/648* (2006.01)

(52) U.S. Cl. ..... 439/102; 439/108; 439/607

(58) Field of Classification Search ..... 439/83, 439/92, 95, 101, 102, 108, 567, 571
See application file for complete search history.

(56) References Cited

U.S. PATENT DOCUMENTS 5,496,183 A * 3/1996 Soes et al. ..... 439/79
6,561,849 B2 * 5/2003 Naito et al. ..... 439/607
6,717,818 B1 * 4/2004 Lin ..... 361/753
2008/0119072 A1 * 5/2008 Chang et al. ..... 439/83
2008/0119082 A1 * 5/2008 Cheng ..... 439/345
2008/0233775 A1 * 9/2008 Cheng ..... 439/108
2008/0261418 A1 * 10/2008 Ting et al. ..... 439/85
2008/0299794 A1 * 12/2008 Lin et al. ..... 439/68
2009/0029595 A1 * 1/2009 Ting et al. ..... 439/629
2009/0047830 A1 * 2/2009 Lin et al. ..... 439/607

FOREIGN PATENT DOCUMENTS

CN 99251977.2 12/2000

* cited by examiner

*Primary Examiner*—James Harvey
(74) *Attorney, Agent, or Firm*—Wei Te Chung

(57) ABSTRACT

An electrical card connector assembly includes an electrical card connector (100) and a PCB (4) where the electrical card connector is assembled. The electrical card connector includes a metal shield (1), an insulating housing (2) and a terminal module (3) received in the insulating housing. The insulating housing associates with the metal shield to define a card receiving room. The terminal module includes a body portion (30) and a plurality of terminals (31) received in the body portion. The metal shield forms a base (10) and a plurality of sidewalls (11) extending vertically from the base. The metal shield further comprises at least one elastic piece (13) extending from the edge of the base, which forms a grounding portion (131) at a free end thereof. The PCB defines at least one grounding pad (47) mating with the grounding portion of the elastic piece.

13 Claims, 9 Drawing Sheets

ELECTRICAL CARD CONNECTOR ASSEMBLY

BACKGROUND OF THE INVENTION

1. Field of the Invention

The present invention relates generally to electrical card connector assemblies, and more particularly to an electrical card connector assembly having improved ESD (electrostatic discharge) protection.

2. Description of Related Arts

With a digital development of the electronic technology, removable electric products that are taken away with people themselves, such as Personal Digital Assistants (PDA), Digital Still Cameras (DSC) or etc, are more and more popular. The electronic product requires an electrical card for storing message, and then transferring information between the electronic product and another one. Such kind of card with rapider accessing speed and lower electricity is more and more used and becomes a standard in an electronic field.

An electrical card connector is usually assembled on a printed circuit board (PCB) of an electronic product and the electrical card connector in daily use usually includes a shield for preventing EMI (Electro Magnetic Interference). However, electrostatic charges is usually accumulated thereon and may damage to both the electrical card and the electronic product. So, grounding elements are acquired urgently for discharging the electrostatic charges. An electrical card connector 1' as we know is shown as FIGS. 1-3, which includes an insulating housing 10', a plurality of terminals 11', a covering shield 12', an ejector 13' and etc. The covering shield 12' is partially assembled on the insulating housing 11' at a front part thereof. A rear part of the covering shield 12' comprises a bottom piece 121', a pair of lateral pieces 122' extending vertically and upward from two edges of the bottom piece 121' and a pair of top pieces 123' each extending from a free end of the lateral piece 122' along a direction parallel to the bottom piece 121'. So, the bottom piece 121' associates the lateral pieces 122' and the top pieces 123' to define a card receiving room. Each top piece 123' forms a grounding piece 124' at a middle part thereof and the grounding pieces 124' bend toward the PCB 2' for contacting with grounding pads 20' of the PCB 2' to discharge electrostatic charges. However, the grounding piece 124' is formed in a shape that a thickness in a vertical direction is smaller than a width in a level direction, and as a result, a rigidity of the grounding piece 124' along the vertical direction is small and a large pressure may damage it so that the grounding pieces 124' are not in excellent connection with the grounding pads 20' of the PCB 2' and obviously, the grounding purpose is not achieved. Secondly, the grounding piece 124' is formed on the top piece 123' which extends vertically and upward from the bottom piece 121' and then continues to extend horizontally to form the card receiving room, it makes a structure of this product complicated and the manufacturing process rather troublesome. Additionally, for the grounding piece 124' is hidden underside the covering shield 1', we can't make sure whether a correct connection is achieved or not between the grounding pieces 124' and the grounding pads 20' in the assembling process but only to be noticed in use during which there may be an accident. For example, a great quantity of the electrical card connectors provided to customers don't suit for their requirement in size because of some man-made mistakes, some accident said above may occur.

Hence, an improved electrical card connector assembly is desired.

SUMMARY OF THE INVENTION

Accordingly, an object of the present invention is to provide an electrical card connector assembly having improved ESD protection.

To achieve the above object, an electrical card connector assembly includes an electrical card connector and a PCB where the electrical card connector is assembled. The electrical card connector includes a metal shield, an insulating housing and a terminal module received in the insulating housing. The insulating housing associates with the metal shield to define a card receiving room. The terminal module includes a body portion and a plurality of terminals received in the body portion. The metal shield forms a base and a plurality of sidewalls extending vertically from the base. The metal shield further comprises at least one elastic piece extending from the edge of the base, which forms a grounding portion at a free end thereof. The PCB defines at least one grounding pad mating with the grounding portion of the elastic piece.

Other objects, advantages and novel features of the invention will become more apparent from the following detailed description when taken in conjunction with the accompanying drawings.

DETAILED DESCRIPTION OF THE PREFERRED EMBODIMENT

Figure 1:
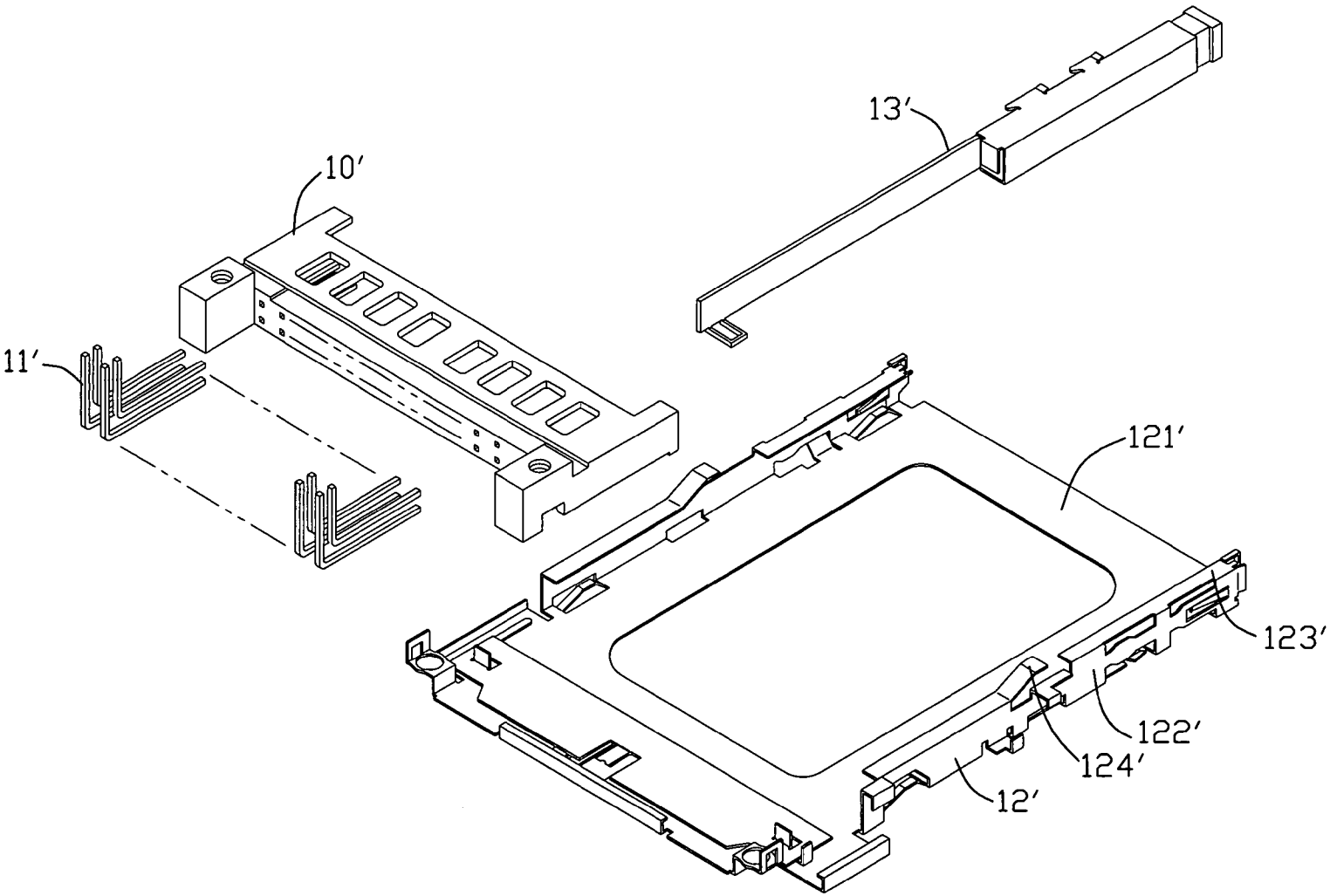
FIG. 1 (PRIOR ART)
FIG. 1 is a perspective, exploded view of an electrical card connector according to a prior art.
Figure 2:
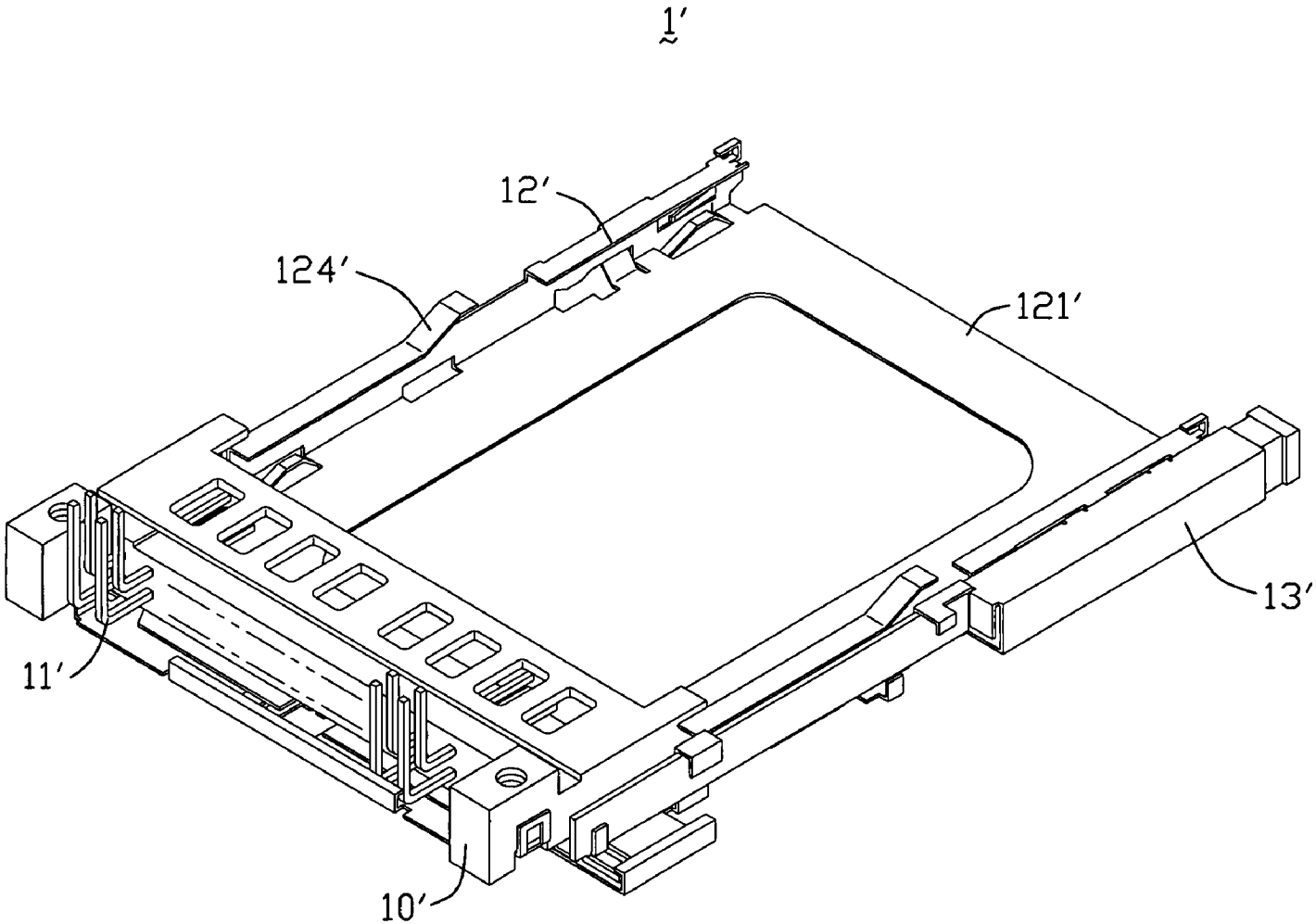
FIG. 2 (PRIOR ART)
FIG. 2 is a perspective, assembled view of the electrical card connector of FIG. 1.
Figure 3:
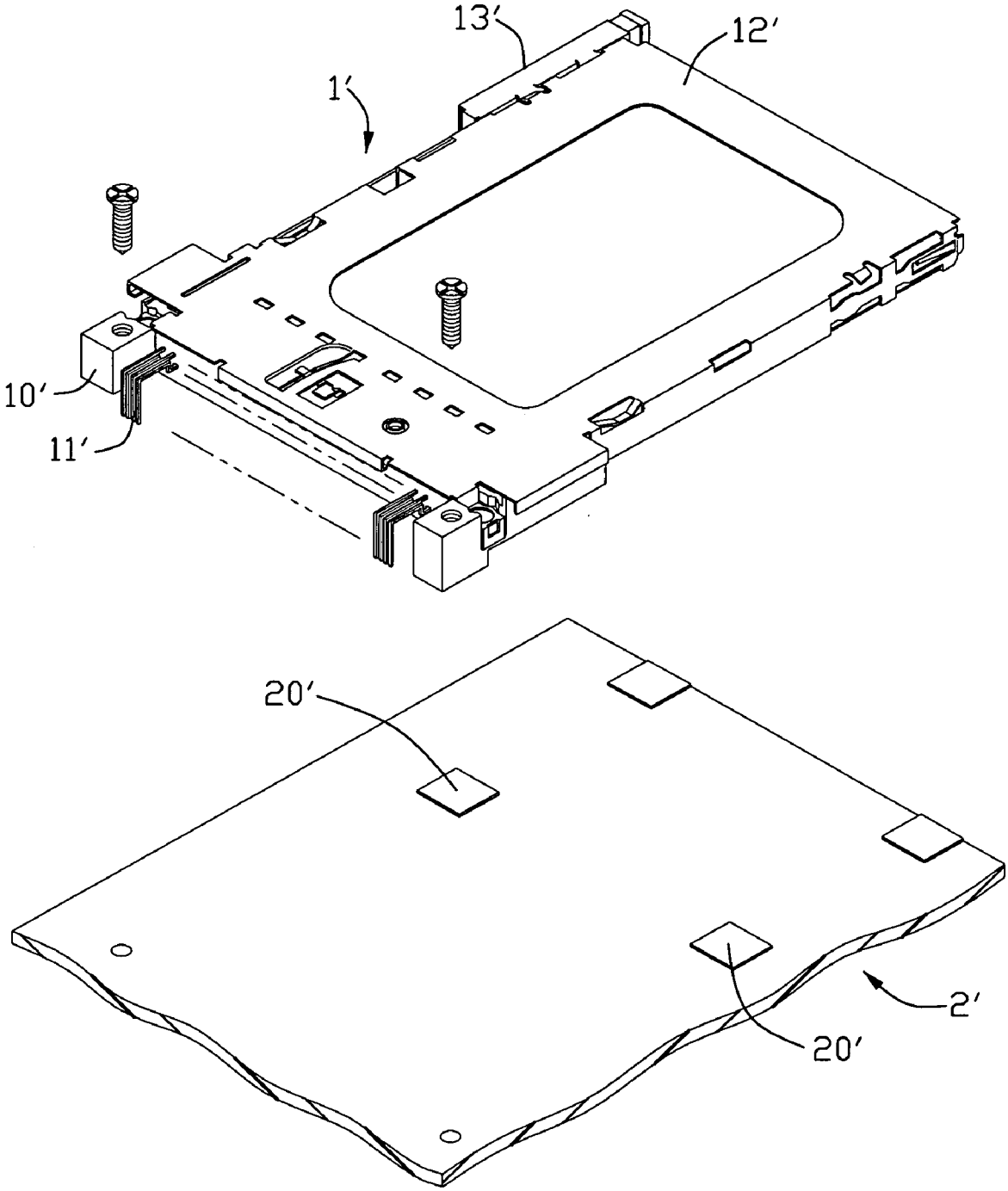
FIG. 3 (PRIOR ART)
FIG. 3 is a perspective view of the electrical card connector and the mating PCB in the prior art.

FIGS. 4-9 illustrate an electrical card connector assembly includes an electrical card connector 100 and a PCB 4 having grounding pads 47. The electrical card connector 100 comprises a metal shield 1, an insulating housing 2 and a terminal module 3, which is installed on the PCB 4 and also received in the insulating housing 2. The metal shield 1 associates with the insulating housing 2 to define a card receiving room (not labeled) for receiving an electrical card (not shown), and accordingly, a card insertion/ejection direction is also defined.

Figure 4:
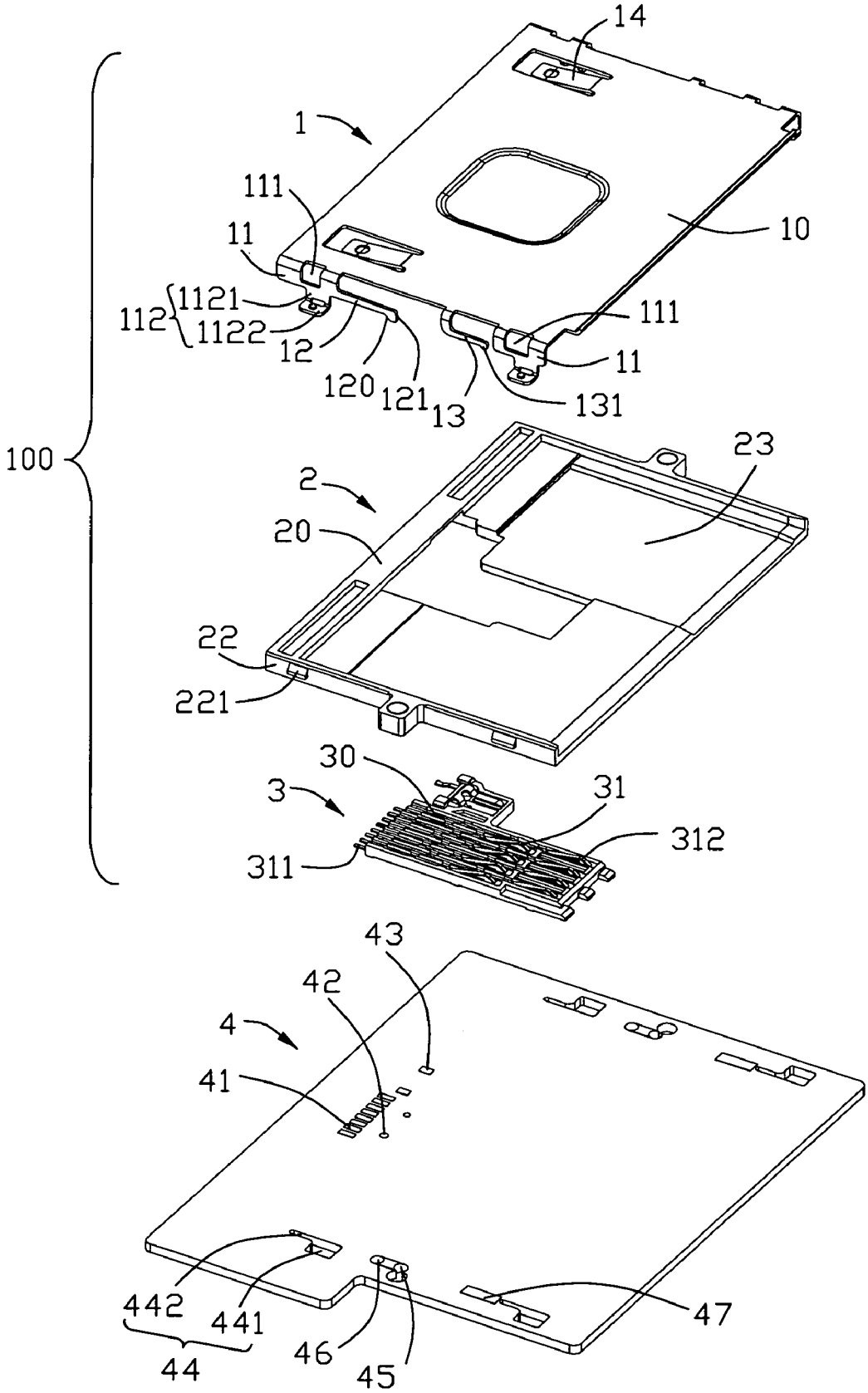
FIG. 4 is a perspective, exploded view of the electrical card connector assembly of the present invention.

Referring to FIG. 4, the metal shield 1 forms a base 10 and a plurality of sidewalls 11 extending vertically and downwardly from two edges of the base 10. Each sidewall 11 defines an opening 111 and at least one sidewall 11 forms a locking portion 112 having a vertical portion 1121 and a horizontal portion 1122 extending horizontally from a lower end of the vertical portion 1121. An interspace is arranged between the sidewalls 11 on the same edges and a flexible piece 12 extends from one of the sidewalls 11 along the card insertion/ejection direction and into the interspace. The flexible piece 12 comprises a free end having a declined portion 120 for guiding purpose and a confronting portion 121 standing in an approximately vertical direction for resisting purpose. An elastic piece 13, extending from an edge of the base 10, is located in the interspace too, whose extending direction is same to the flexible piece 12. The free end of the elastic piece 13 forms a grounding portion 131 which faces toward the PCB 4. Each elastic piece 13 has a thickness in a vertical direction larger than a width in a level direction, which makes a rigid performance of the elastic piece 13 in the vertical direction and accordingly, the elastic piece 13 can endure a much larger pressure which makes the elastic piece 13 not be damaged to disconnect with the grounding pad 47 after a long time of use. So does the flexible piece 12 and the flexible piece 12 is difficult to be damaged. The base 10 further comprises a plurality of suppressing pieces 14 for keeping the electrical card close connection with the terminal module 3. In fact, "the flexible piece 12 extends from the sidewall 11" and "the elastic piece 13 extends from an edge of the base 10" are descriptive but not to be limited, on the other hand, either the flexible piece 12 or the elastic piece 13 extends from the sidewall 11 or extends from an edge of the base 10 is essentially a same manner.

Figure 5:
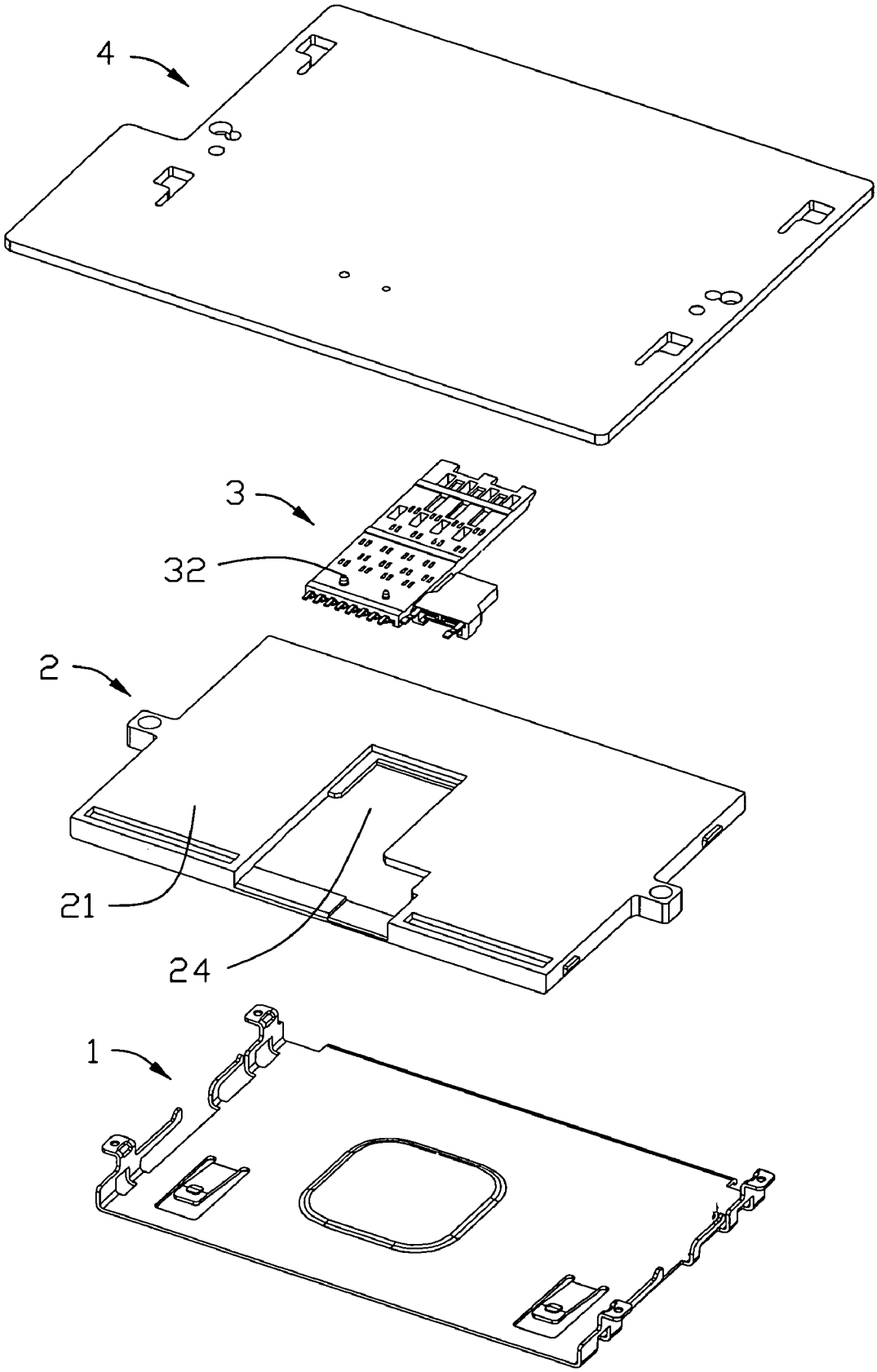
FIG. 5 is a view similar to FIG. 4, but taken from a different aspect.
Figure 6:
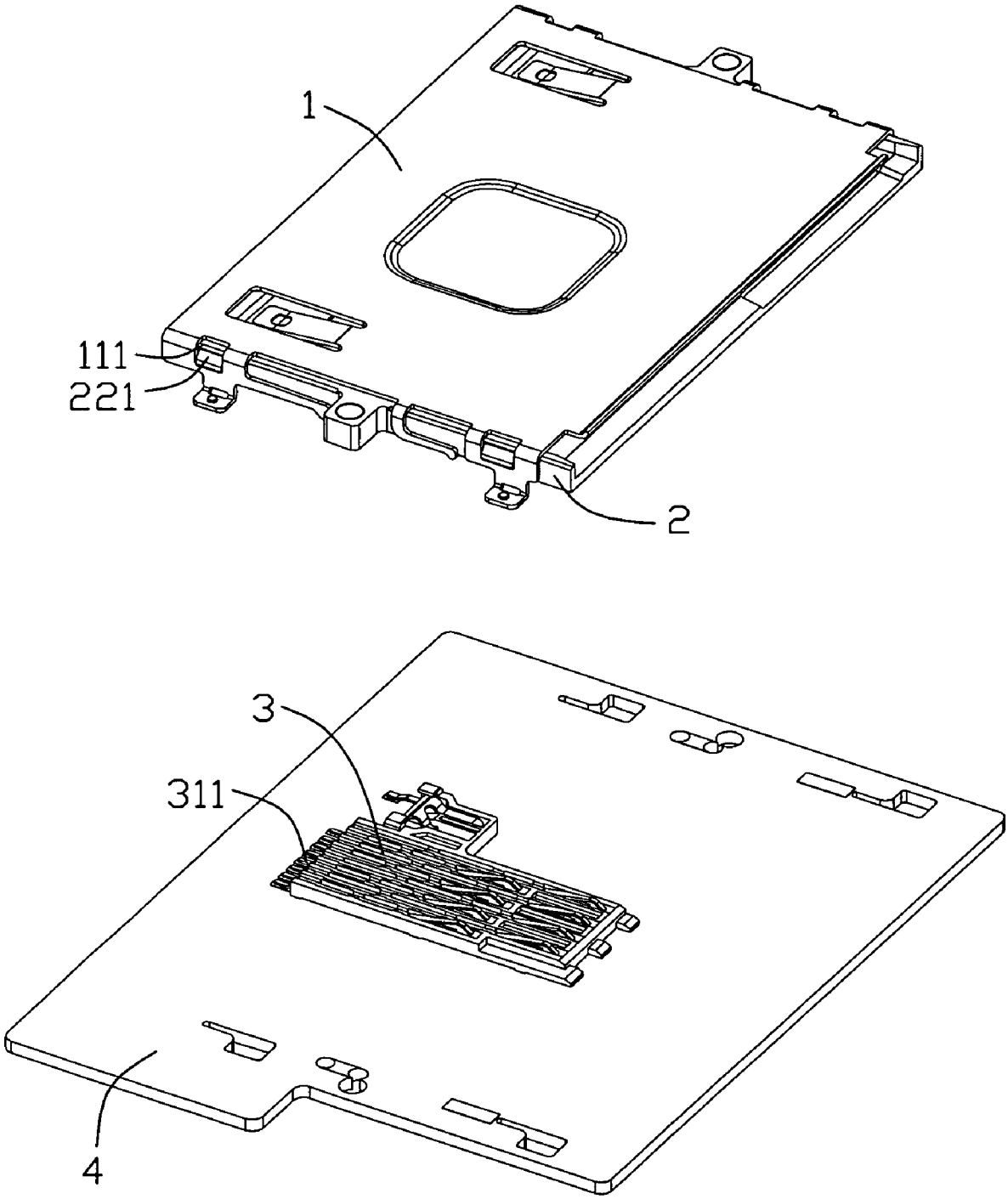
FIGS. 6-8 is a view of the process of the electrical card connector integrated with the PCB.

Referring to FIGS. 4 and 5, the insulating housing 2 comprises an upper surface 20, a bottom surface 21 and lateral walls 22. Each lateral wall 22 forms a plurality of protrusions 221 correspondingly received in the openings 111 for associating the metal shield 1 with the insulating housing 2. The upper surface 20 of the insulating housing 2 comprises a depressed portion 23 at a front part thereof for forming the card receiving room. The bottom surface 21 of the insulating housing 2 comprises a receiving portion 24 at a rear part thereof for receiving the terminal module 3.

Continuing to refer to FIGS. 4 and 5, the terminal module 3 comprises a body portion 30 and a plurality of signal terminals 31 each having a soldering portion 311 and a contacting portion 312. The signal terminals 31 are arranged in two row-arrays along the card insertion/ejection direction and the contacting portions 312 extend beyond a top surface of the body portion 30 and into the card receiving room so as to electrically contact with the electrical card. The body portion 30 forms a pair of protruding tabs 32 on a bottom surface thereof for assembling the terminal module 3 on the PCB 4.

Referring to FIG. 4, the PCB 4 comprises soldering pads 41, a pair of receiving holes 42 and a pair of soldering pieces 43. A pair of cutouts 44 are defined in each edge of the PCB 4. As is clearly shown in FIG. 4, the cutout 44 is like a character "P" in shape, and includes a first slot 441 and a second slot 442 communicating with the first slot 441 at a side part thereof. The width of the first slot 441 is larger than that of the second slot 442. A first aperture 45 and a second aperture 46 are linearly located between the pair of cutouts 44 in the same edge of the PCB 4. Each grounding pad 47, having a lengthwise figure, is also located between the pair of cutouts 44 in the same edge of the PCB 4. Strictly speaking, a line defined by the first aperture 45 and the second aperture 46 along a same side, a line the grounding pad 47 extending lengthwise and a line defined by the second slot 442 having a narrower width are all remained in a same straight line or at least parallel lines, which makes sure that in an assembling process, just at the time of the vertical portion 1121 of the locking portion 112 sliding into the second slot 442, the free end of the flexible piece 12 goes from the first aperture 45 into the second aperture 46 and the grounding portion 131 of the elastic piece 13 is electrically connected with the grounding pad 47.

In assembly, firstly, the soldering portions 311 of the signal terminals 31 are soldered with the soldering pads 41 and the protruding tabs 32 of the terminal module 3 are received in the receiving holes 42 of the PCB 4, accordingly, the terminal module 3 is assembled on the PCB 4; secondly, the metal shield 1 is integrated with the insulating housing 2 because of the protrusions 221 and the corresponding openings 111; following, the locking portions 112 of the metal shield 1 are first aligned with and extend through the cutouts 44 of the PCB 4, each free end of the flexible piece 12 is located in the first aperture 46 just at this time, and meanwhile, the grounding portion 131 of the elastic piece 13 is attached to the grounding pad 47; then, the integration of the metal shield 1 and the insulating housing 2 moves along the card insertion/ejection direction, until the vertical portion 1121 of each locking portion 112 moves into the second slot 442, whereby the horizontal portion 1122 of the locking portion 112 confronts a bottom surface of the PCB 4 for providing a locking force in a vertical direction, meanwhile, the flexible piece 12 leaves the first aperture 45 under the guidance of the declined portion 120 and slides into the second aperture 46. Because the confronting portion 121 of the flexible piece 12 confronts the PCB 4 in the second aperture 47, a force is produced to prevent the electrical card connector 100 from moving towards an opposite direction relative to the PCB 4. The grounding portion 131 of the elastic piece 13 slides on the grounding pad 47 but never escape the grounding pad 47.

Figure 7:
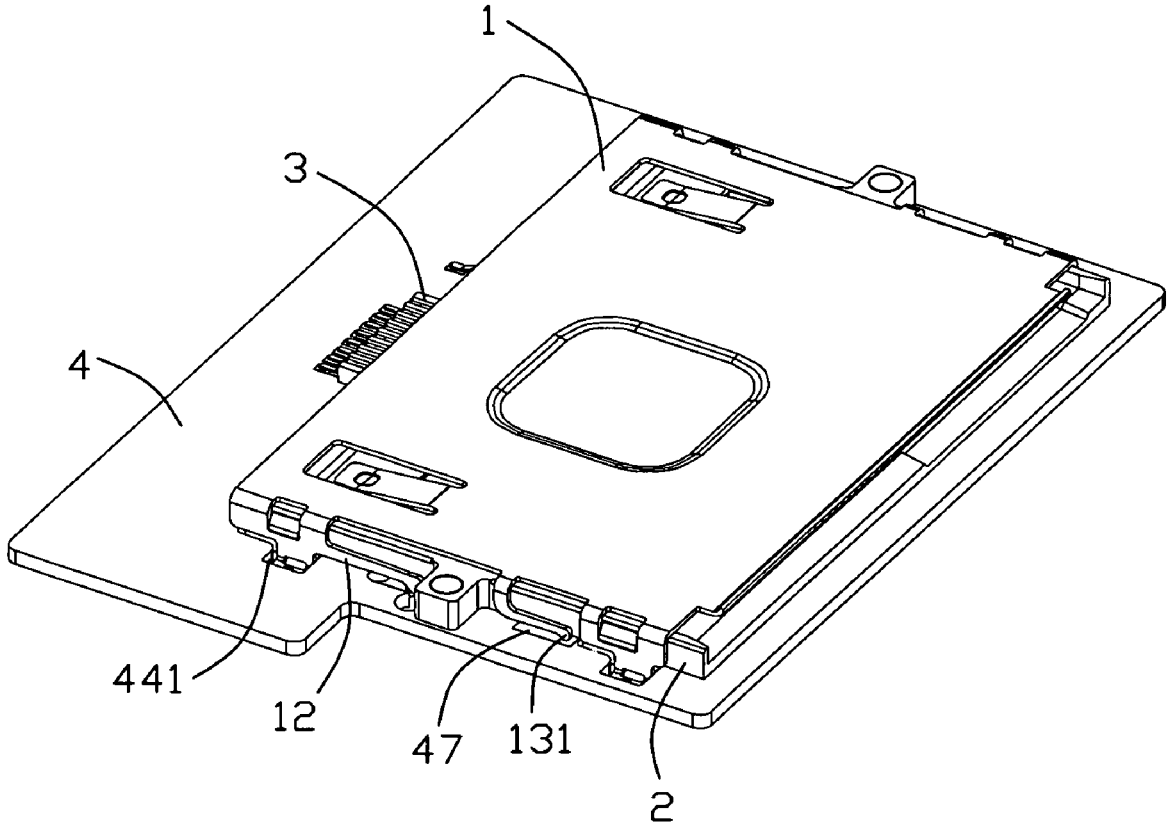
Figure 8:
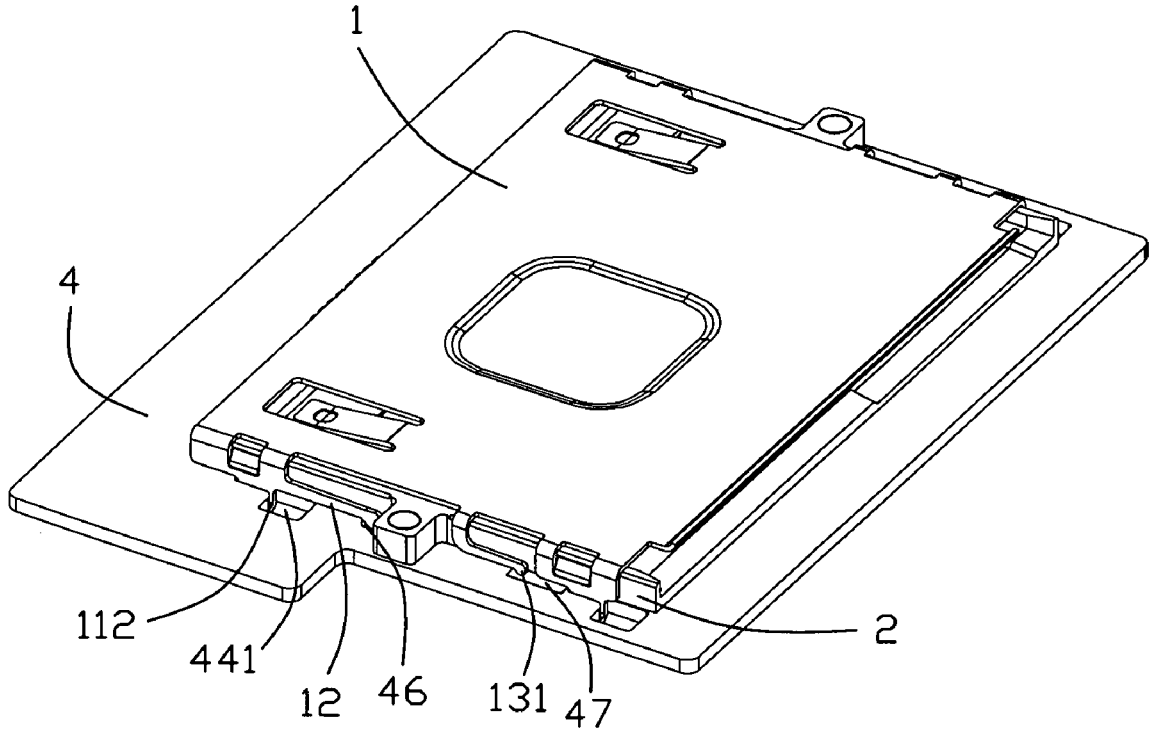
Figure 9:
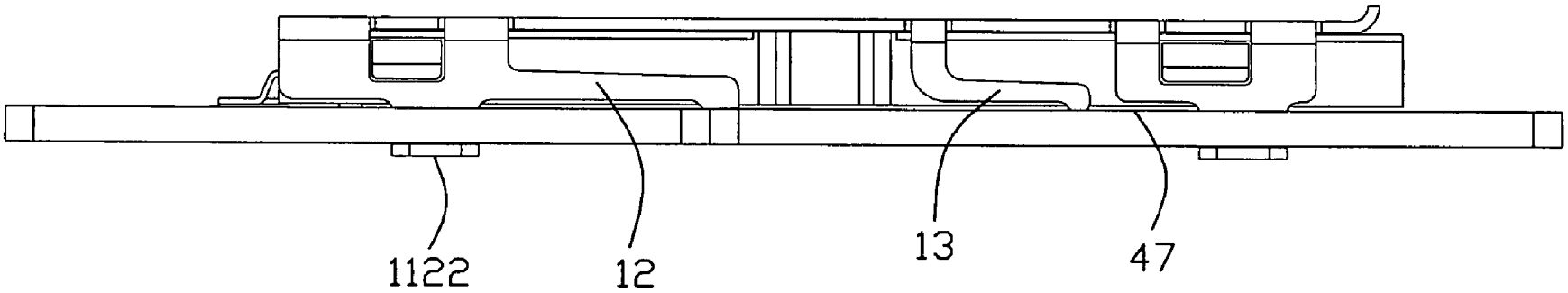
FIG. 9 is a side view of electrical card connector assembly.

In the present invention, the electrical card connector 100 comprises a pair of elastic pieces 13 each having a grounding portion 131 mating with the grounding pad 47 of the PCB 4 and each elastic piece 13 has the thickness in the vertical direction larger than the width in the level direction and as a result, the piece 13 is so rigid that it is not easy to be damaged despite of larger pressure, and thus, the elastic piece 13 is attached to the grounding pad 47 all the time and the invention can attach an excellent grounding purpose. Additionally, each elastic piece 13 extends directly from the edge of the base 10 like the sidewalls 11, which makes the structure of the metal shield 1 simple and so does the manufacturing process. Practically, the elastic piece 13 is located at a side of the metal shield 1, which is different to the grounding pieces 124' in the prior art, and therefore, users can clearly take a look at the movement of the grounding portion 131 on the grounding pad 47 in the assembling process and make sure that the grounding portion 131 is attached to the grounding pad 47 for ever, which is shown in FIGS. 7-8.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical card connector assembly comprising:

an electrical card connector comprising:

an insulating housing;

a terminal module received in the insulating housing, the terminal module comprising a body portion and a plurality of terminals received in the body portion;

a metal shield associating with the insulating housing to define a card receiving room, the metal shield comprising a base, a plurality of sidewalls extending from the base and at least one elastic piece extending from an edge of the base, the at least one elastic piece forming a grounding portion at a free end thereof, and a PCB defining at least one grounding pad mating with the grounding portion of the elastic piece.

2. The electrical card connector assembly as described in claim 1, wherein the elastic piece extends along a card insertion/ejection direction.

3. The electrical card connector assembly as described in claim 1, wherein one of the sidewalls forms a flexible piece extending along a card insertion/ejection direction.

4. The electrical card connector assembly as described in claim 3, wherein the flexible piece extends along a direction same to the elastic piece.

5. The electrical card connector assembly as described in claim 3, wherein the flexible piece forms a free end and the PCB defines at least one aperture locking with the free end of the flexible piece.

6. The electrical card connector assembly as described in claim 5, wherein the free end of the flexible piece comprises a confronting portion standing in an approximately vertical direction and a declined portion for guiding purpose.

7. The electrical card connector assembly as described in claim 6, wherein each sidewall forms a locking portion and the PCB defines a plurality of cutouts mating with the locking portions.

8. The electrical card connector assembly as described in claim 7, wherein each locking portion forms a vertical portion and a horizontal portion extending from a lower end of the vertical portion.

9. The electrical card connector assembly as described in claim 7, wherein each cutout comprises a first slot and a narrower second slot communicating with the first slot.

10. The electrical card connector assembly as described in claim 8, wherein the aperture and the grounding pad are arranged along a line defined by the second slots of the two cutouts at a same edge of the PCB.

11. The electrical card connector assembly as described in claim 1, wherein the terminals are arranged in two-row arrays.

12. The electrical card connector assembly as described in claim 11, wherein each terminal has a contacting portion and a soldering portion, and the contacting portions extend beyond a top surface of the terminal module and into the card receiving room.

13. An electrical card connector assembly comprising:

an electrical card connector comprising:

an insulating housing;

a terminal module received in the insulating housing, the terminal module comprising a body portion and a plurality of terminals received in the body portion;

a metal shield associating with the insulating housing to define a card receiving room, the metal shield comprising a base, a plurality of sidewalls extending from the base and at least one elastic piece extending from the edge of the base, the elastic piece forming a grounding portion at a free end thereof, at least one sidewall forming a flexible piece and a locking portion having a horizontal portion; and a PCB defining a grounding pad mating with the grounding portion of the elastic piece, an aperture locking with a free end of the flexible piece and a cutout through which the locking portion extends and then the horizontal portion confronts a bottom surface of the PCB.

* * * * *